US009056749B2

(12) United States Patent
Utsunomiya

(10) Patent No.: US 9,056,749 B2
(45) Date of Patent: Jun. 16, 2015

(54) CONTROL DEVICE OF ELEVATOR DOOR INCLUDING OBSTRUCTION DETECTION USING EQUIVALENT STIFFNESS DETERMINATION

(75) Inventor: Kenji Utsunomiya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 729 days.

(21) Appl. No.: 13/390,400

(22) PCT Filed: Aug. 4, 2010

(86) PCT No.: PCT/JP2010/004891

§ 371 (c)(1),
(2), (4) Date: Feb. 14, 2012

(87) PCT Pub. No.: WO2011/030502

PCT Pub. Date: Mar. 17, 2011

(65) Prior Publication Data

US 2012/0138393 A1 Jun. 7, 2012

(30) Foreign Application Priority Data

Sep. 10, 2009 (JP) ..... 2009-209333

(51) Int. Cl.
*B66B 13/14* (2006.01)
*B66B 13/26* (2006.01)

(52) U.S. Cl.
CPC ..... *B66B 13/26* (2013.01); *B66B 13/143* (2013.01)

(58) Field of Classification Search
CPC ..... B66B 13/143; B66B 13/26
USPC ..... 187/247, 316, 317, 391, 393; 318/466–470; 49/26, 29
See application file for complete search history.

(56) References Cited

U.S. PATENT DOCUMENTS 4,732,238 A * 3/1988 Baumgartner ..... 187/317
5,131,506 A 7/1992 Mizuno et al.
5,373,120 A * 12/1994 Barrett et al. ..... 187/316

(Continued)

FOREIGN PATENT DOCUMENTS

EP 1 985 570 A2 10/2008
JP 03 238286 10/1991

(Continued)

OTHER PUBLICATIONS

Office Action issued on Jun. 18, 2013 in the corresponding German Patent Application No. 11 2010 003 619.5 (with English Translation).

(Continued)

*Primary Examiner* — Anthony Salata
(74) *Attorney, Agent, or Firm* — Oblon, McClelland, Maier & Neustadt, L.L.P.

(57) ABSTRACT

A control device of an elevator door includes moving quantity detector which detects the moving quantity of a driving device of the door for opening and closing, and a driving force detector which detects a driving torque or driving force of the driving device. An equivalent stiffness calculator estimates the equivalent stiffness of an object in contact from an output signal of the moving quantity detector and an output signal of the driving force detector. The door is reversed or stopped by comparing the estimated equivalent stiffness of an object in contact as a contact determination parameter with a threshold value.

10 Claims, 12 Drawing Sheets

(56) References Cited

U.S. PATENT DOCUMENTS

| | | | | |
|---|---|---|---|---|
| 5,384,439 | A * | 1/1995 | Ernecke et al. | 187/316 |
| 5,585,702 | A * | 12/1996 | Jackson et al. | 318/266 |
| 5,789,887 | A * | 8/1998 | Elischewski | 318/468 |
| 5,841,083 | A * | 11/1998 | Schonauer et al. | 187/316 |
| 6,064,165 | A * | 5/2000 | Boisvert et al. | 318/465 |
| 6,404,158 | B1 * | 6/2002 | Boisvert et al. | 318/469 |
| 6,445,152 | B1 * | 9/2002 | Calamatas | 318/445 |
| 6,854,565 | B2 * | 2/2005 | Perala et al. | 187/393 |
| 2008/0263964 | A1 | 10/2008 | Ludwig et al. | |
| 2009/0272605 | A1 * | 11/2009 | Utsunomiya et al. | 187/316 |

FOREIGN PATENT DOCUMENTS

| | | |
|---|---|---|
| JP | 08 157168 | 6/1996 |
| JP | 2000 128465 | 5/2000 |
| JP | 2006 182477 | 7/2006 |
| JP | 2007 254070 | 10/2007 |
| JP | 2009 173368 | 8/2009 |

OTHER PUBLICATIONS

International Search Report issued on Oct. 5, 2010 in PCT/JP10/04891 filed on Aug. 4, 2010.

Office Action issued Apr. 28, 2014 in Chinese Patent Application No. 201080040269.2 (with English translation).

Combined Chinese Office Action and Search Report issued Sep. 13, 2013, in Chinese Patent Application No. 201080040269.2 with English translation of the text of Office Action and with English translation of category of cited documents.

* cited by examiner

CONTROL DEVICE OF ELEVATOR DOOR INCLUDING OBSTRUCTION DETECTION USING EQUIVALENT STIFFNESS DETERMINATION

TECHNICAL FIELD

The present invention relates to a control device controlling opening and closing of an elevator door.

BACKGROUND ART

FIG. 1 is a diagram showing a front view of the door apparatus of an elevator.

A suspension jig 2 is provided at the upper end of a door panel 1. In the upper edge portion of an entrance not shown in the figure, there is provided a beam 3 whose length is arranged horizontally. The beam 3 is provided with a guide rail 4 which is arranged in a longitudinal horizontal direction. The guide rail 4 guides the horizontal movement of the suspension jig 2, i.e., the movement of the door panel 1 in opening and closing. Two pulleys 5 are pivotally fit on the beam 3 in such a manner as to be spaced from each other. An endless belt 6 is wound on both of the two pulleys 5 and is provided in a tensioned state.

A connecting jig 7 is such that one end thereof is connected to the suspension jig 2 and the other end thereof is connected to the belt 6. An electric motor 9, which is an example of a driving device, drives one of the pulleys 5 under instructions from a door controller 8. That is, when the electric motor 9 is driven, the pulleys 5 rotate and the belt 6 is driven, whereby the suspension jig 2 and door panel 1 which are connected by the connecting jig 7 to the belt 6 move in directions reverse to each other because of the movement of the belt 6 to open and close the entrance. For example, as indicated by the arrows in the FIG. 1, when the electric motor 9 rotates clockwise, the door panel 1 moves horizontally in the closing direction.

A safety shoe 10 is installed in the door panel 1. For example, in the case where the safety shoe 10 is pushed in by human contact to the door panel 1 side when the door panel 1 is driven in the closing direction, the door controller 8 sends reversal instructions to the electric motor 9 and causes the door panel 1 to be reversed in the opening direction, thereby reducing loads on obstacles (hereinafter referred to as the human body and the like) to the opening and closing of the door.

However, it is not always that the safety shoe 10 operates before contact to the door panel 1, and it seems that contact to the door panel 1 occurs before the operation of the safety shoe 10. In this case, a large contact force acts on the human body and the like.

Although there is a technique which involves reversing the door panel 1 by make a determination using a noncontact sensor, which is not shown, whether or not there is an obstacle in the moving direction of the door panel 1, this technique has the problems that it is difficult to completely eliminate blind spots of the detection region of a noncontact sensor and a large contact force may act on the human body and the like, that the cost increases due to the addition of a noncontact sensor, and so on.

As conventional techniques for reducing a contact force in the case where such a safety shoe 10 and a noncontact sensor, which is not shown, does not operate, there are techniques which involve monitoring a torque instruction value of an electric motor and reversing a door panel when a torque instruction value of not less than a prescribed limit value has continued for a prescribed time or longer (refer to Patent Literature 1, for example).

As techniques for reversing a door panel, there are techniques which involve providing a torque estimator which estimates an electric motor torque from opening and closing patterns, and detecting an overload when a difference between a torque instruction value and an estimated value has exceeded a threshold value (refer to Patent Literature 2, for example).

As techniques for reversing a door panel, in addition to those described above, there have been disclosed techniques which involve detecting an overload of an electric motor in two stages, arousing attention by use of means which issues alarms for a slight overload, and reversing the door panel for an excessive overload (refer to Patent Literature 3, for example).

Patent Literature 1: Japanese Patent Laid-Open No. 3-238286 (page 3)

Patent Literature 2: Japanese Patent Laid-Open No. 2006-182477 (page 4, FIG. 1)

Patent Literature 3: Japanese Patent Laid-Open No. 2007-254070 (pages 2 and 3, FIG. 3)

SUMMARY OF INVENTION

Technical Problem

The conventional techniques given in Patent Literature 1 and Patent Literature 2 both are techniques in which attention is paid to an increase in the torque of the electric motor 9 during contact to the human body and the like. However, the torque of the electric motor 9 not only depends on parameters, such as the weight of the door panel 1 and opening and closing speed patterns, which can be known to some extent beforehand, but also is affected by parameters, such as the frictional resistance and the variety of losses in opening and closing of the door panel 1 which are difficult to predict beforehand and vary with time.

Therefore, if a torque abnormality determination value for a normal value determined beforehand is set to be a small value, a reversal occurs even when the door panel 1 does not come into contact with the human body and the like and the time which elapses until the start of the ascent and descent of a car becomes long, resulting in a worsened operation efficiency. In order to prevent such worsening of the operation efficiency, it is necessary that an abnormality determination value be set to be a large value to a certain degree, and it is difficult to sufficiently reduce a contact force during the collision of the door panel 1, thereby posing a problem.

To solve the problem that such a determination threshold value cannot be made small, the conventional technique given in Patent Literature 3 is intended for preventing the worsening of the operation efficiency by a useless reversal by dividing an overload detection threshold value 2 into two stages and arousing attention for a slight overload by use of alarm means. However, when the door panel 1 has come into contact with the human body and the like, the time which elapses from a slight overload to an excessive overload is a moment, and a large contact force acts on the human body and the like before a response to an alarm, with the result that the contact force to the human body and the like cannot be reduced, thereby posing a problem.

The present invention has been made to solve the problems described above, and the object of the invention is to obtain a control device of an elevator door into which the concept of equivalent stiffness is introduced and which does not bring about the worsening of the operation efficiency due to a useless door panel reversal and reduces a contact force of a door panel 1 on the human body and the like. Incidentally, the meaning of the above-described "equivalent stiffness" will be given in the description of the embodiments presented below.

Means for Solving the Problems

A control device of an elevator door of the present invention includes a door panel which opens and closes a hall, a driving device which drives the door panel in opening and closing, moving quantity detection means which detects the rotation quantity or moving quantity of the driving device, driving force detection means which detects a driving torque or driving force of the driving device or calculates a driving torque instruction value or a driving force instruction value to the driving device, force reference value estimation means which estimates a torque reference value or force reference value of the driving device during normal opening and closing and equivalent stiffness calculation means which estimates equivalent stiffness of an object in contact from an output signal of the moving quantity detection means, an output signal of the driving force detection means and an output of the force reference value estimation means, wherein the door panel is caused to be reversed or to stop by comparing the estimated equivalent stiffness of an object in contact as a contact determination parameter with a threshold value.

Advantageous Effects of Invention

Although the torque of the electric motor 9 increases in the case of an increase in friction and the like, a decrease in the door speed and the moving quantity is small because of the effect of speed follow-up control. The present invention is less apt to be affected by environmental disturbances, such as friction, because the contact of the human body and the like with the door panel 1 is evaluated as the equivalent stiffness of an object in contact which is expressed by torque/moving quantity, which includes not only a torque increase, but also a decrease in the moving quantity. Therefore, because it is unnecessary to set a determination threshold value for the reversal of the door panel 1 to be too large a value, the present invention has the effect that a contact force acing on the door panel 1 during the collision of the human body and the like against the door panel 1 can be reduced.

DESCRIPTION OF SYMBOLS

1 door panel, 9, 32 driving device,
11, 26, 27 driving force detection means,
16, 31, 808 moving quantity detection means
18, 25 force reference value estimation means
806 equivalent stiffness calculation means

DESCRIPTION OF EMBODIMENTS

Embodiment 1

Figure 1:
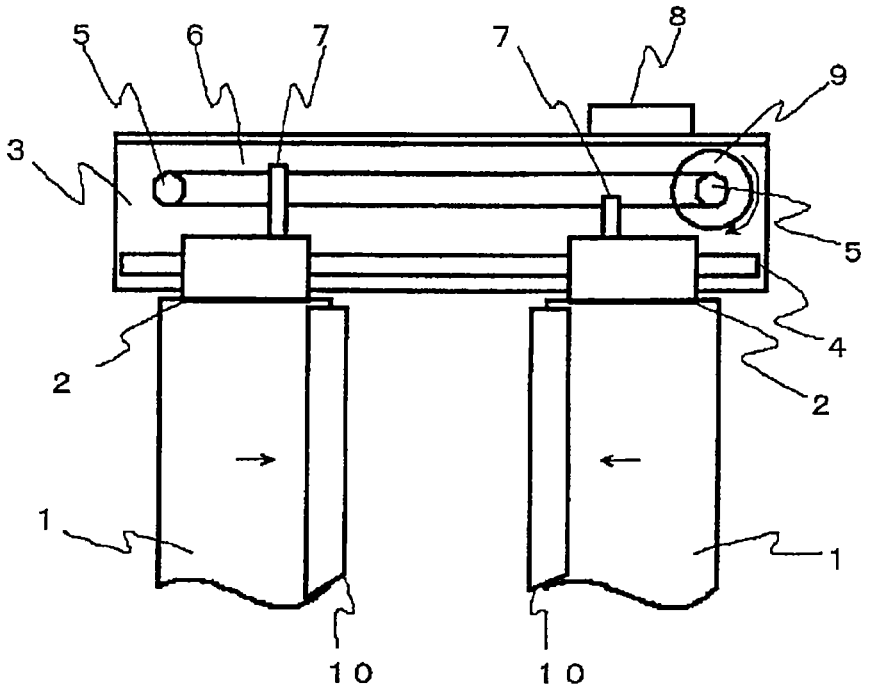
FIG. 1 PRIOR ART
FIG. 1 is a diagram showing a front view of the door apparatus of an elevator.
Figure 2:
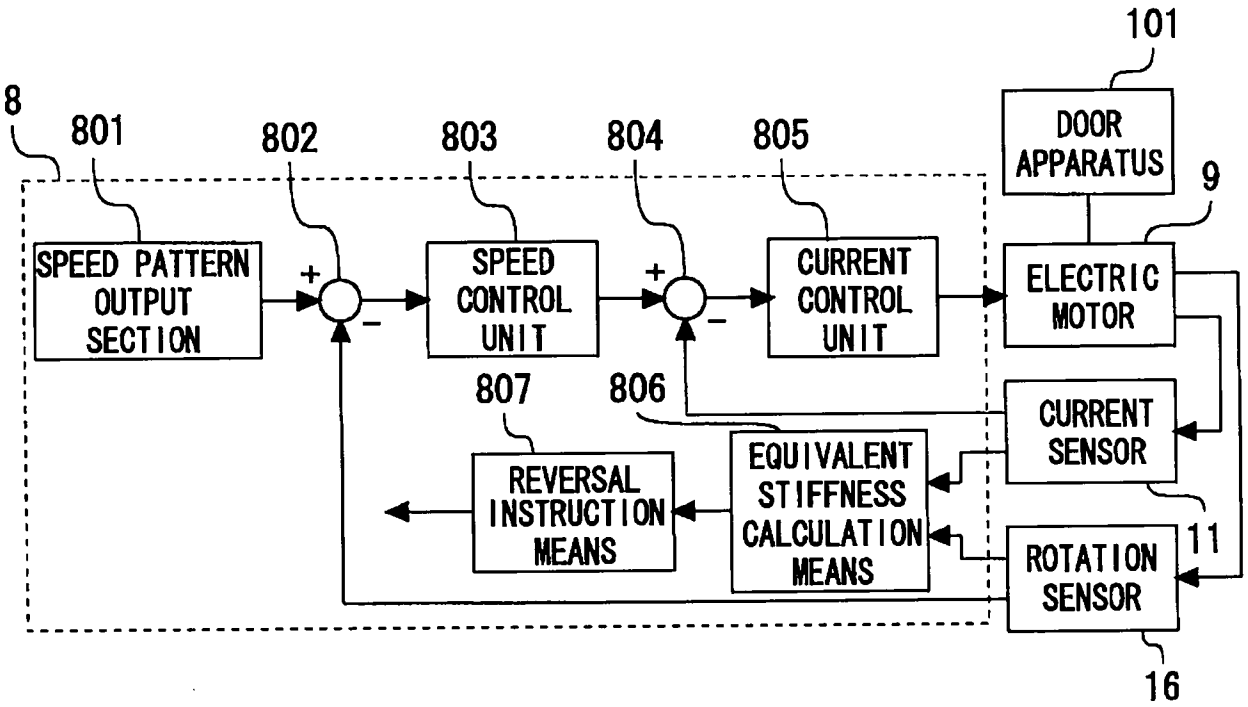
FIG. 2 is a control block diagram in Embodiment 1 and 2 of the present invention.

The arrangement of the door equipment of an elevator is omitted because it is the same as that described with the aid of FIG. 1 in the background art. FIG. 2 is a control block diagram in Embodiment 1 of the present invention. An electric motor 9, which is an example of a driving device installed in a door apparatus 101 is provided with a current sensor 11, which is an example of driving force detection means which detects a current caused to flow through the electric motor 9, and a rotation sensor 16 which detects the rotation of the electric motor 9.

In a door controller 8, a speed instruction value of the electric motor 9 is outputted by a speed pattern output section 801. The speed instruction value is compared by a subtractor 802 with the rotation speed of the electric motor 9 detected by the rotation sensor 16, and the difference is inputted to a speed control unit 803. The speed control unit 803 calculates a current instruction value so that a speed difference, which is an output of the subtractor 802, becomes small, and outputs the current instruction value. The description of the speed control unit 803 is omitted because what is inside the speed control unit 803 may be a PI control unit and the like which are well known to those skilled in the art and does not constitute an essential point of the present invention.

A current instruction value outputted from the speed control unit 803 is compared by a subtractor 804 with a current value of the electric motor 9 detected by the current sensor 11, and the difference is inputted to a current control unit 805. The current control unit 805 calculates a voltage instruction value so that a current difference, which is an output of the subtractor 804, becomes small, and outputs the voltage instruction value to the electric motor 9. The description of the current control unit 805 is omitted because the current control unit 805 may be a P control unit and the like which are well known to those skilled in the art and does not constitute an essential point of the present invention.

As described above, the door controller 8 feeds back values detected by the current sensor 11 and the rotation sensor 16 and performs control so that the electric motor 9 follows a speed instruction value generated in the speed pattern output section 801. Therefore, even when a disturbance force is added from the outside, the speed follow-up characteristic is ensured to a certain extent.

Suppose that the human body and the like have come into contact with the door panel 1, then because the movement of the door panel 1 is prevented, the rotation quantity of the electric motor 9 detected by the rotation sensor 16 decreases and the amount of current to the electric motor 9 detected by the current sensor 11 increases due to the action of the speed control unit 803. Equivalent stiffness calculation means 806 which calculates equivalent stiffness inputs signals from the current sensor 11, which is an example of driving force detection means, and from the rotation sensor 16, which is an example of moving quantity detection means, and calculates the equivalent stiffness of an object which has come into contact with the door panel 1. When this equivalent stiffness value has reached a prescribed value, the equivalent stiffness calculation means 806 transmits a collision detection signal to reversal instruction means 807. Upon receipt of the collision detection signal, the reversal instruction means 807 issues instructions to the effect that the door panel 1 performs a reversal operation.

Figure 3:
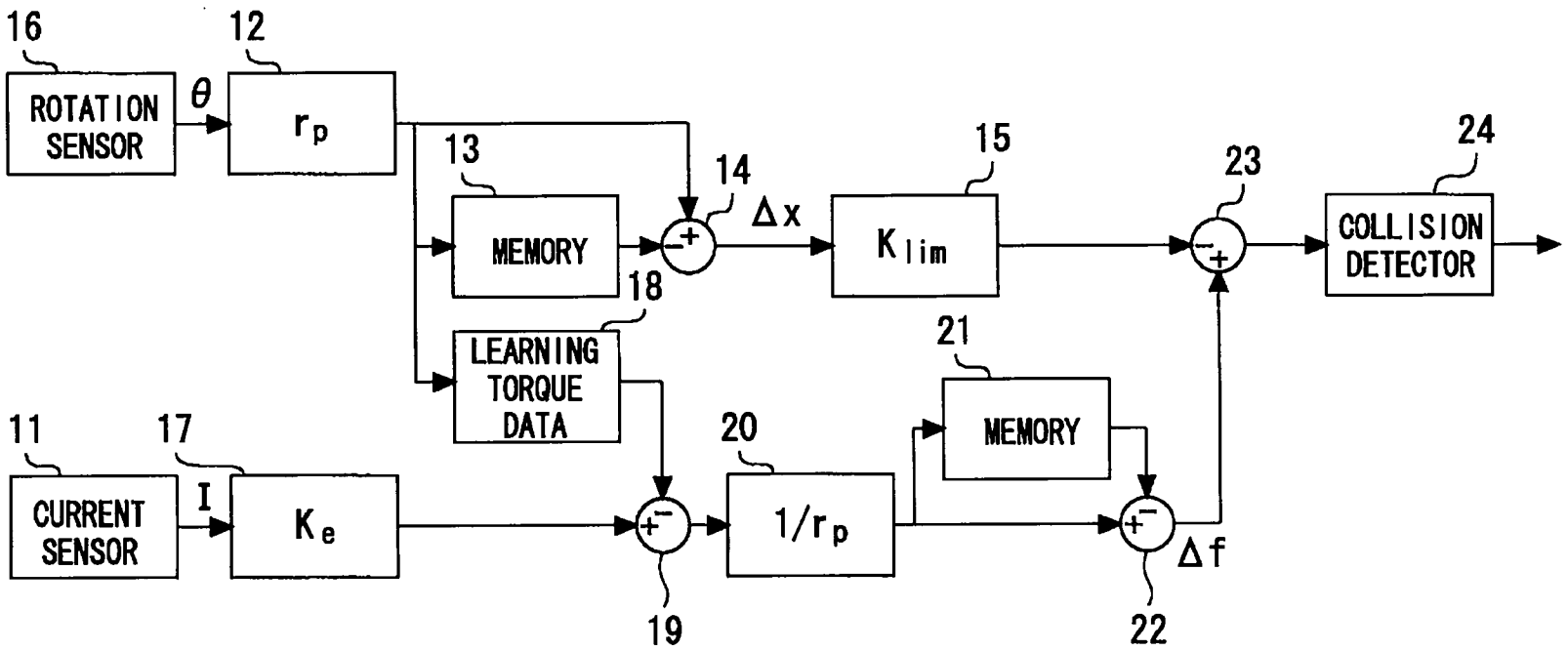
FIG. 3 is a block diagram showing the equivalent stiffness calculation means in Embodiment 1 of the present invention.

FIG. 3 is a block diagram showing the details of the equivalent stiffness calculation means 806. The rotation angle θ of the electric motor 9 detected by the rotation sensor 16 is multiplied by the radius $r_p$ of the pulley 5 installed in the electric motor 9 through the use of a gain block 12, and the moving quantity of the door panel 1 is calculated: $x(t)=\theta r_d$. A memory 13 is adapted to store the value $x(t-\Delta t)$ of the moving quantity x(t) before a prescribed time Δt. In a subtractor 14, as a difference between the present moving quantity x and the moving quantity $x(t-\Delta t)$ before a prescribed time, which is outputted from the memory 13, the moving quantity difference Δx is calculated: $\Delta x=x(t)-x(t-\Delta t)$. The moving quantity difference Δx is outputted by being multiplied by the contact determination stiffness threshold value $K_{lim}$ through the use of a gain block 15.

The current value 1 detected by the current sensor 11 is multiplied by the torque constant Ke through the use of a gain block 17, whereby the present driving torque τ(t) is calculated. A learning torque data block 18, which is an example of force reference value estimation means, stores the torque data of the electric motor 9 in normal times for the moving quantity x. The present moving quantity x(t) is inputted to the learning torque data block 18, which outputs a torque reference value in a noncontact case $\tau_0(t)$.

In a subtractor 19, as a difference between the present actual torque τ(t) and the present torque reference value $\tau_0(t)$, the present overload torque $\tau_e(t)$ is calculated: $\tau_e(t)=\tau(t)-\tau_0(t)$. The overload torque $\tau_e(t)$ is multiplied by $1/r_p$ through the use of a gain block 20 and becomes the present overload force $f(t)=\tau_e(t)/r_p$. In a memory 21, the value $f(t-\Delta t)$ of the overload force f(t) before a prescribed time Δt is stored, and the increased force Δf is calculated in a subtractor 22: $\Delta f=f(t)-f(t-\Delta t)$.

If we express the equivalent stiffness of an object in contact when the door panel 1 has come into contact with the human body and the like by K, K can be estimated as follows: $K=\Delta f/\Delta x$. The stiffness of an object in contact is expressed by the ratio of the deformation volume to the force required for causing deformation. It is apparent that strictly, the deformation volume difference Δx includes also components other than a pure deformation volume of an object in contact. In this sense, the estimated stiffness value K is called equivalent stiffness. If reversal instructions are issued to the door panel 1 when equivalent stiffness K has become not less than the contact determination threshold $K_{lim}$, the contact determination formula is given by Formula (1).

[Formula 1]

$$K=\Delta f/\Delta x \geq K_{lim} \qquad \text{Formula (1)}$$

In general, the division process in calculations on a CPU causes problems such as division by zero, Formula (1) is used after being transformed into Formula (2).

[Formula 2]

$$\Delta f-K_{lim}\Delta x \geq 0 \qquad \text{Formula (2)}$$

In a subtractor 23 of FIG. 3, $\Delta f-K_{lim}\Delta x$ shown in the left side of Formula (2) is calculated. When this value is not less than zero, a collision detector 24 outputs a collision signal and the door panel 1 is controlled so as to be reversed.

When something has collided with the door panel 1, the current value indicating the torque of the electric motor 9 increases and the rotation quantity of the motor 9 decreases greatly. On the other hand, the current value increases for friction which becomes a disturbance considered in estimating a collision, but owing to the effect of a speed control unit 803 the rotation quantity does not decrease so much. Because in the invention shown in Embodiment 1, contact is determined by paying attention not only to the current value equivalent to the driving torque of the electric motor 9, but also to the rotation quantity of the motor 9, it is possible to reduce the effect of a disturbance occurring with time, such as friction. Therefore, because the determination threshold value of equivalent stiffness can be set to be a small value without being affected by a disturbance such as friction, it becomes to possible to detect the collision of the door panel 1 earlier, with the result that the invention has the remarkable effect that a contact force on the human body and the like can be reduced.

Figure 6:
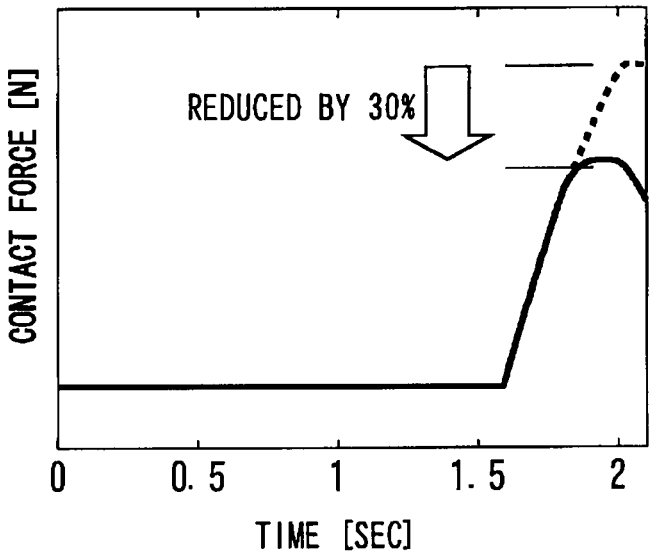
FIG. 6 is a graph showing an effect in Embodiment 1 of the present invention.

FIG. 6 shows an example of the results of a simulation of a door reversal during contact. The broken line indicates a contact force acting when collision detection only by a conventional electric motor torque is used, and the solid line indicates a contact force acting when the present invention is used. In the present invention, it can be verified that the contact force can be reduced by approximately 30% or so compared to conventional techniques.

Embodiment 2

Figure 4:
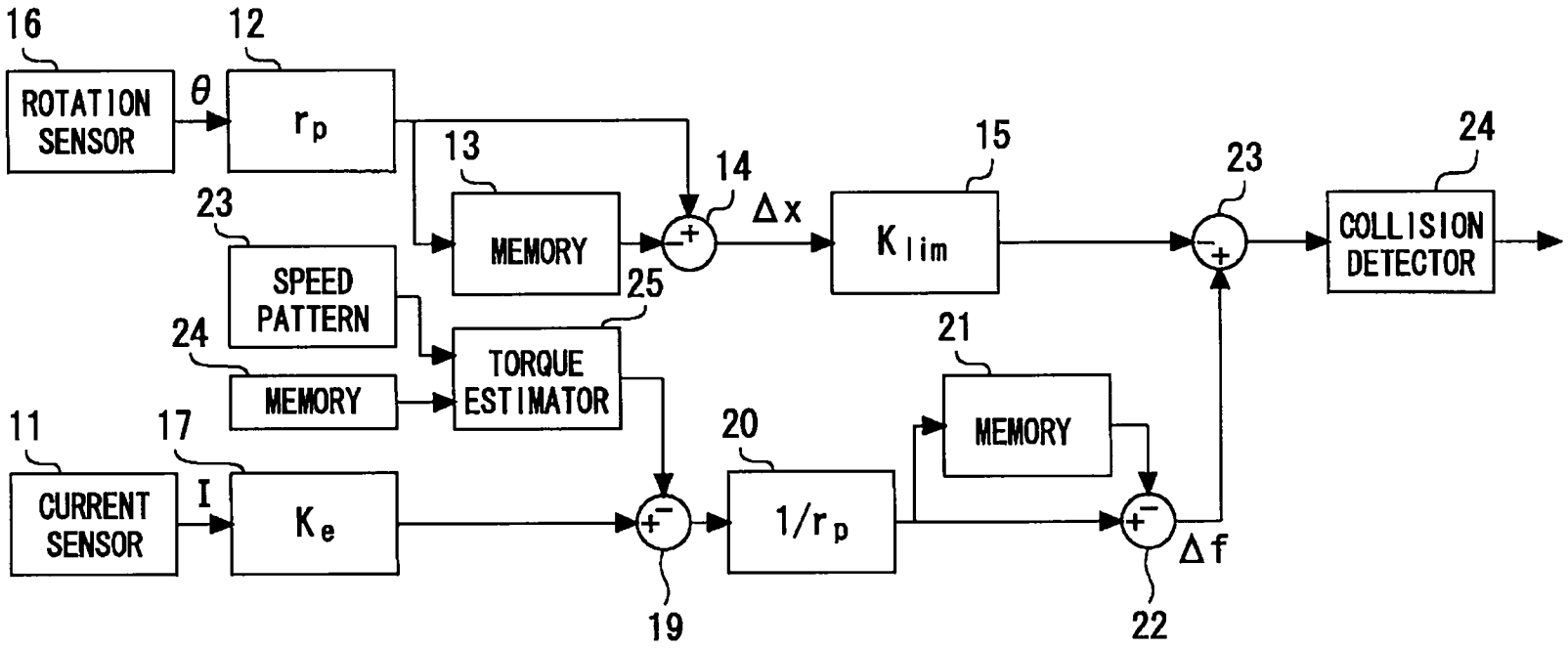
FIG. 4 is a block diagram showing the equivalent stiffness calculation means in Embodiment 2 of the present invention.

The descriptions of the arrangement of the door equipment shown in FIG. 1 and the basic control block diagram shown in FIG. 2 are omitted because they are the same as in Embodiment 1. Embodiment 2 differs from Embodiment 1 only in what is inside equivalent stiffness calculation means 806. FIG. 4 is a block diagram showing what is inside equivalent stiffness calculation means 806 in Embodiment 2. In FIG. 4, the calculation method of the present torque reference value $\tau_0(t)$ is different from that of FIG. 3.

If the rotation acceleration of the electric motor 9 is denoted by α, the total inertia in the driving by the electric motor 9 is denoted by J, and a disturbance force such as friction is denoted by $F_f$, then the driving torque τ of the electric motor 9 is given by Formula (3).

[Formula 3]

$$\tau=J\alpha+F_f r_p \qquad \text{Formula (3)}$$

The total inertia J and the disturbance torque $F_f r_p$ are stored in the memory 24 of FIG. 4. The total inertia J and the disturbance torque $F_f r_p$ may be constants which are inputted beforehand (may be zero, for example, when the memory and the like are not used), and may be learning parameters obtained by learning.

An instruction speed pattern is inputted from the speed pattern block 23, and the rotation acceleration a is obtained by the differential value thereof. A torque estimator 25, which is an example of force reference value estimation means, outputs a torque reference value in a noncontact case $\tau_0(t)$.

When the torque reference value is introduced using the torque estimator 25 like this, it becomes unnecessary to store reference torque data for position and, therefore, the present invention has the effect that it is possible to save the number of memories necessary for the door controller 8.

Figure 5:
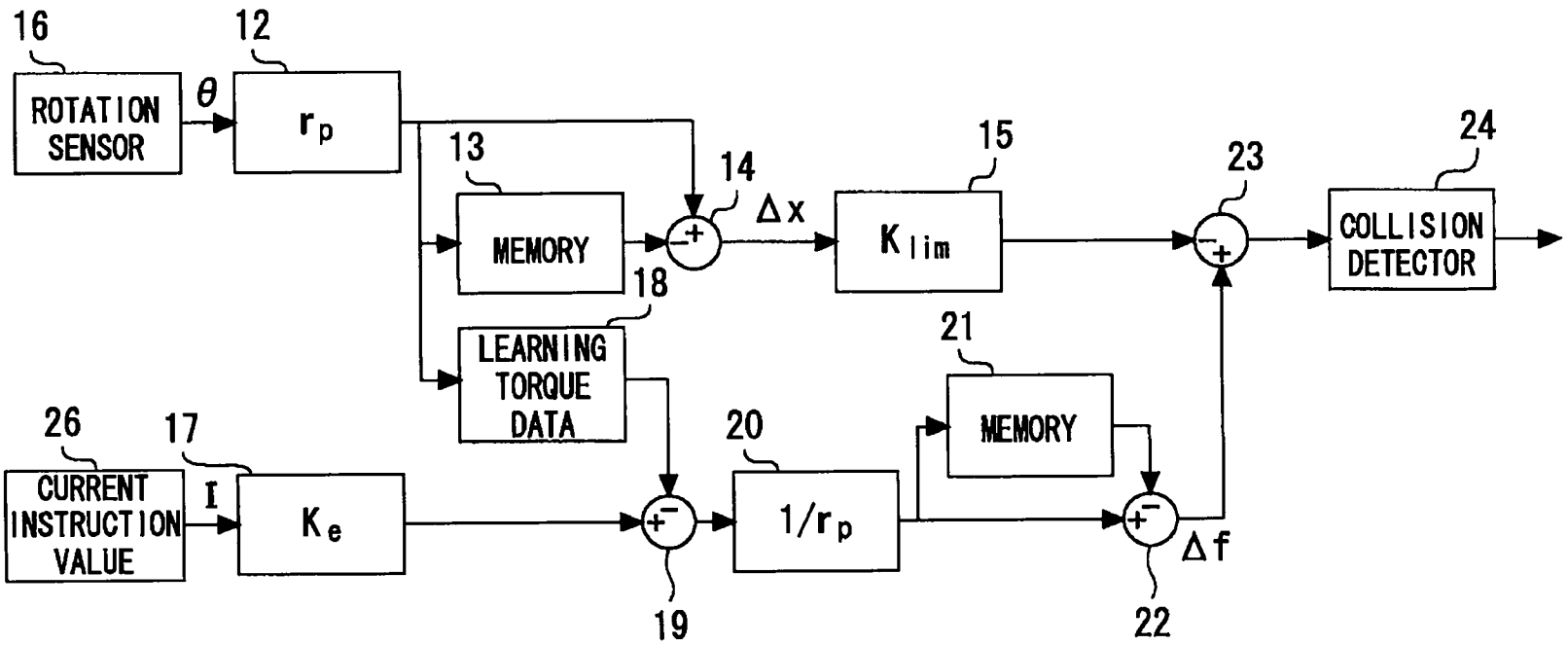
FIG. 5 is a block diagram showing another equivalent stiffness calculation means in Embodiment 1 of the present invention.

In Embodiments 1 and 2, the current sensor 11 is used as an example of driving force detection means to find the present torque $\tau(t)$. However, almost the same effect is obtained by using a current instruction value 26 as an example of driving force detection means, for example, as shown in FIG. 5. FIG. 5 shows the case where in Embodiment 1, the current instruction value 26 is used in place of the current sensor 11 as an example of driving force detection means. It is not needless to say that also in Embodiment 2, though not illustrated, the current instruction value 26 may be used in place of the current sensor 11 as an example of driving force detection means.

Embodiment 3

Embodiment 3 of the present invention will be described below with the aid of FIG. 7.

The contact determination technique by equivalent stiffness described in Embodiments 1 and 2 is particularly effective when the movement of the door panel 1 is considerably limited, for example, when an obstacle having influence on the opening and closing of the door, such as the human body and the like, is caught by the door.

Figure 7:
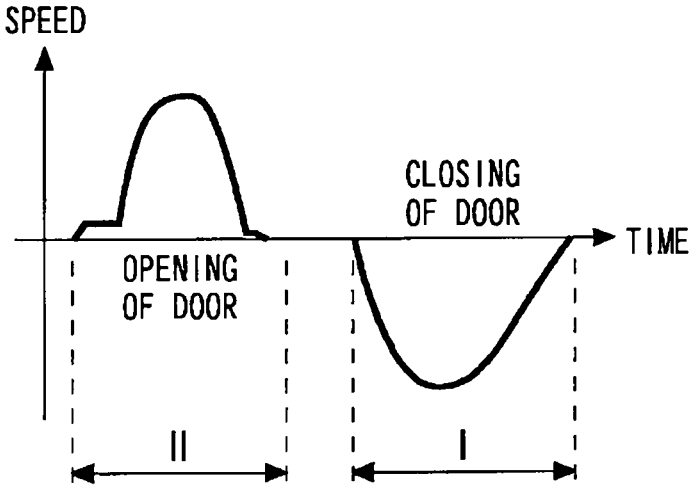
FIG. 7 is a graph showing a control switching method in Embodiment 3 of the present invention.

Therefore, it is possible to adopt a technique by which contact force reducing control I described in Embodiments 1 and 2 is performed, as shown in FIG. 7, when there is the possibility that the human body and the like are caught during the closing of the door, and contact force reducing control is performed by another method II during the opening of the door. By doing like this, it is possible to obtain a contact force reducing effect having higher reliability.

Embodiment 4

Figure 8:
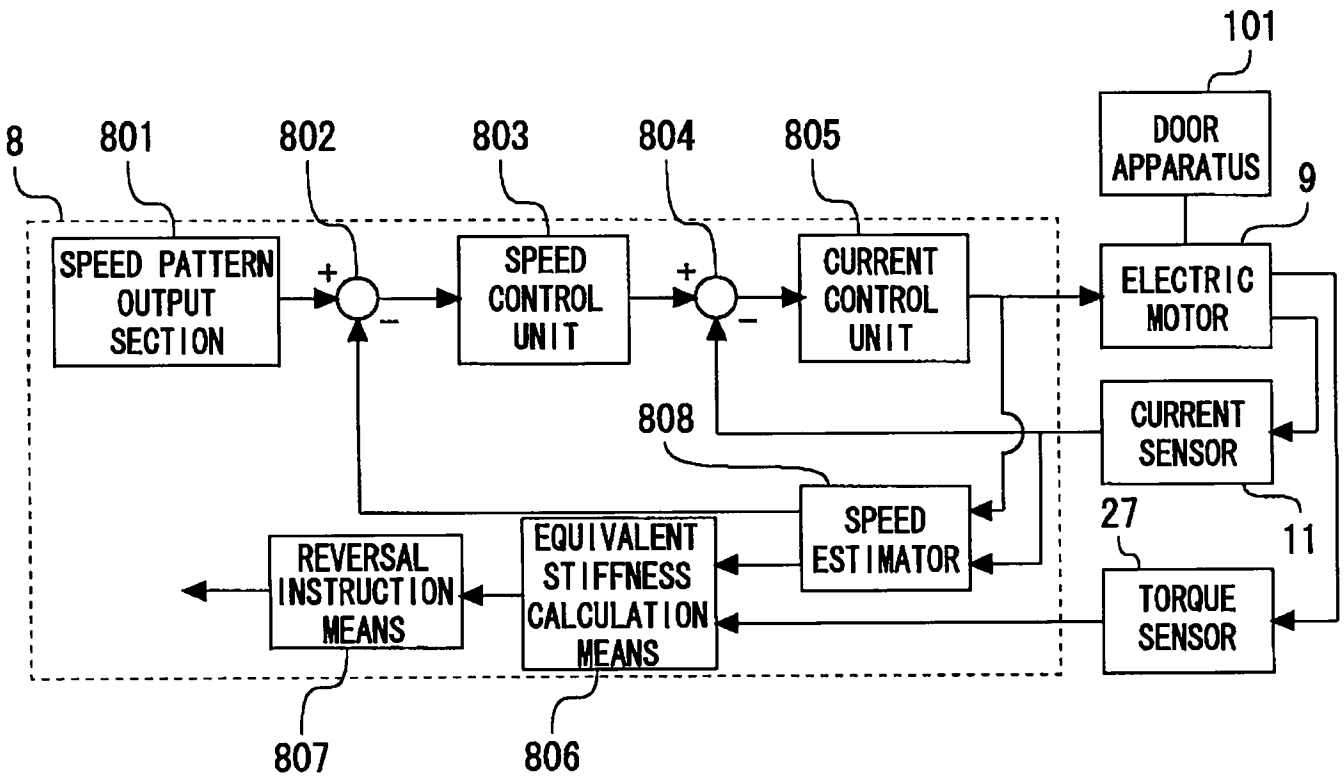
FIG. 8 is a control block diagram in Embodiment 4 of the present invention.

Embodiment 4 of the present invention will be described with the aid of FIG. 8.

The description of the arrangement of the door equipment in shown in Embodiment 4 of the present invention is omitted here because it is the same as in Embodiment 1. FIG. 8 shows a control block diagram in Embodiment 4 of the present invention. In FIG. 8, the descriptions of reference numerals 8, 9, 11 and 801 to 807 are the same as in FIG. 2, corresponding parts bearing like numerals, and hence these descriptions are omitted here. The difference in configuration between FIG. 2 and FIG. 8 is that in FIG. 8, as an example of moving quantity detection means, a speed estimator 808 is provided in place of the rotation sensor 16 and a torque sensor 27 is provided as an example of driving force detection means.

In recent years, sensorless driving techniques without a rotation sensor have been actively studied. For example, Japanese Patent Laid-Open No. 2000-78878 discloses a technique which involves estimating the rotational position of an electric motor 9 from the position dependence of induced voltage. Japanese Patent Laid-Open No. 2004-514392 discloses a technique which involves estimating the rotational position of an electric motor 9 using the saliency of the inductance of an electric motor 9.

The present invention can also be applied to a control apparatus of an elevator door in which such sensorless driving techniques are used. That is, the rotation speed of the electric motor 9 by use of the speed estimator 808 using a voltage instruction value outputted from the current control unit 805 and a measured current value outputted from the current sensor 11. Incidentally, the details of the current estimator 808 are omitted because the current estimator 808 does not constitute the essence of the present invention. As described above, the estimated rotation speed estimated by the speed estimator 808 is used in place of an output signal of the rotation sensor 16. Furthermore, in this embodiment, the driving torque of the electric motor 9 is detected directly by the torque sensor 27 installed in the electric motor 9 instead of calculating the driving torque of the electric motor 9 from the current value of the current sensor 11.

Figure 9:
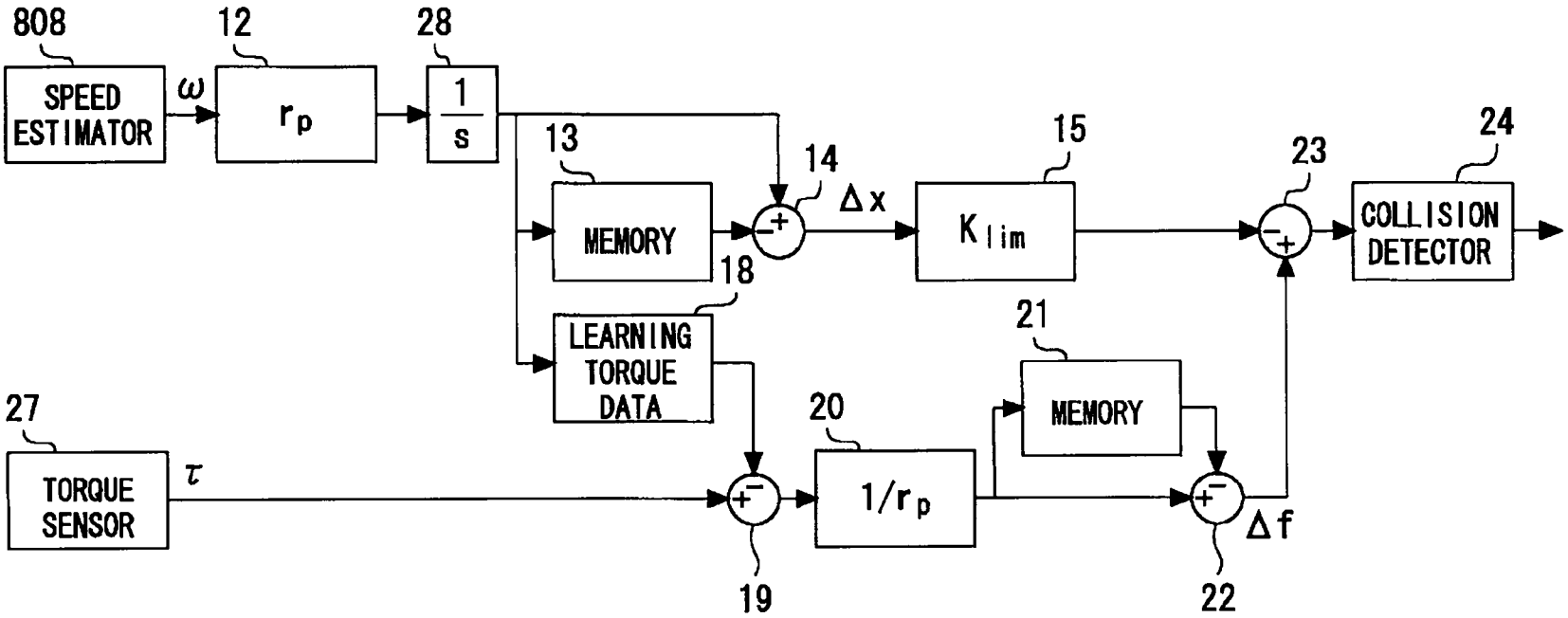
FIG. 9 is a block diagram showing the equivalent stiffness calculation means in Embodiment 4 of the present invention.

FIG. 9 is a block diagram including the details of the equivalent stiffness calculation means 806 in Embodiment 4. Basically, this equivalent stiffness calculation means 806 is the same as the equivalent stiffness calculation means shown in Embodiment 1 and FIG. 3. In FIG. 9, the position x(t) of the door panel 1 is calculated by integrating an product $\omega r_p$ of the estimated angular velocity $\omega$, which is an output of the speed estimator 808, and the radius $r_p$ of the pulley 5, the torque of the electric motor 9 uses a detection signal of the torque sensor 27, and this equivalent stiffness calculation means 806 differs in these points. Because in other respects concerning operation and description Embodiment 4 is the same as in FIG. 3 and Embodiment 1, the description of Embodiment 4 is omitted.

When the door panel 1 has collided with something, the torque of the electric motor 9 increases and the rotation quantity of the electric motor 9 estimated by the speed estimator 808 decreases greatly. On the other hand, the torque increases for friction which becomes a disturbance considered in estimating a collision, but owing to the effect of the speed control unit 803 the rotation quantity does not decrease so much.

In the invention shown in Embodiment 4, because contact is determined by paying attention to t the torque of the electric motor 9 and the rotation quantity of the motor 9 estimated by the speed estimator 808, it is possible to reduce the effect of a disturbance occurring with time, such as friction. Therefore, because the determination threshold value of equivalent stiffness can be set to be a small value without being affected by a disturbance such as friction, it becomes to possible to detect the collision of the door panel 1 earlier, with the result that the invention has the remarkable effect that a contact force on the human body and the like can be reduced.

Embodiment 5

Embodiment 5 of the present invention will be described with the aid of FIGS. 10 and 11.

Figure 10:
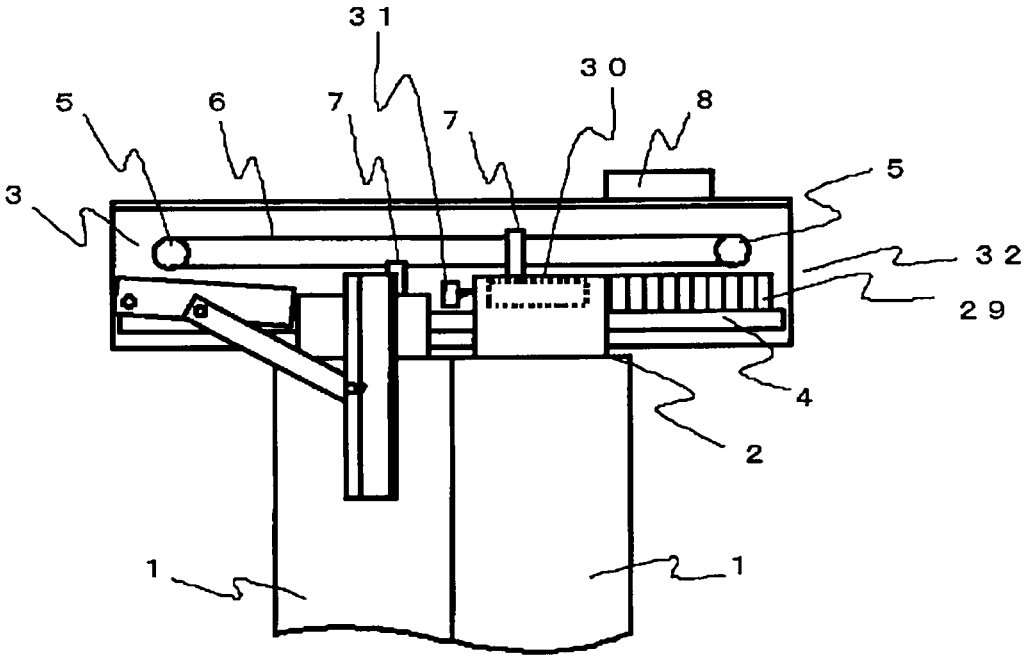
FIG. 10 is a diagram showing a front view of the door apparatus of an elevator in Embodiment 5 of the present invention.

FIG. 10 is a diagram showing the arrangement of the door equipment of an elevator in Embodiment 5. Reference numerals 1 to 8 in FIG. 10 are the same as in FIG. 1 and hence the descriptions of these parts, which bear like numerals, are omitted here. The difference in configuration between FIG. 1 and FIG. 10 is that in FIG. 10, as an example of a driving device of the car side door 1, a linear motor 32 comprising a moving coil 30 and a permanent magnet 29 is used in place of the electric motor 9 and a position sensor 31 is used as an example of moving quantity detection means in place of a rotation sensor.

The present invention can also be applied to a control device of an elevator door in which such a linear motor 32 is used. In the linear motor 32, a current is caused to flow in the moving coil 30, whereby a driving force acts on the permanent magnet 29 in the horizontal direction (of the in-plane direction of paper surface) of FIG. 10. The position of the car-side door 1 at this time is detected by the position sensor 31.

Figure 11:
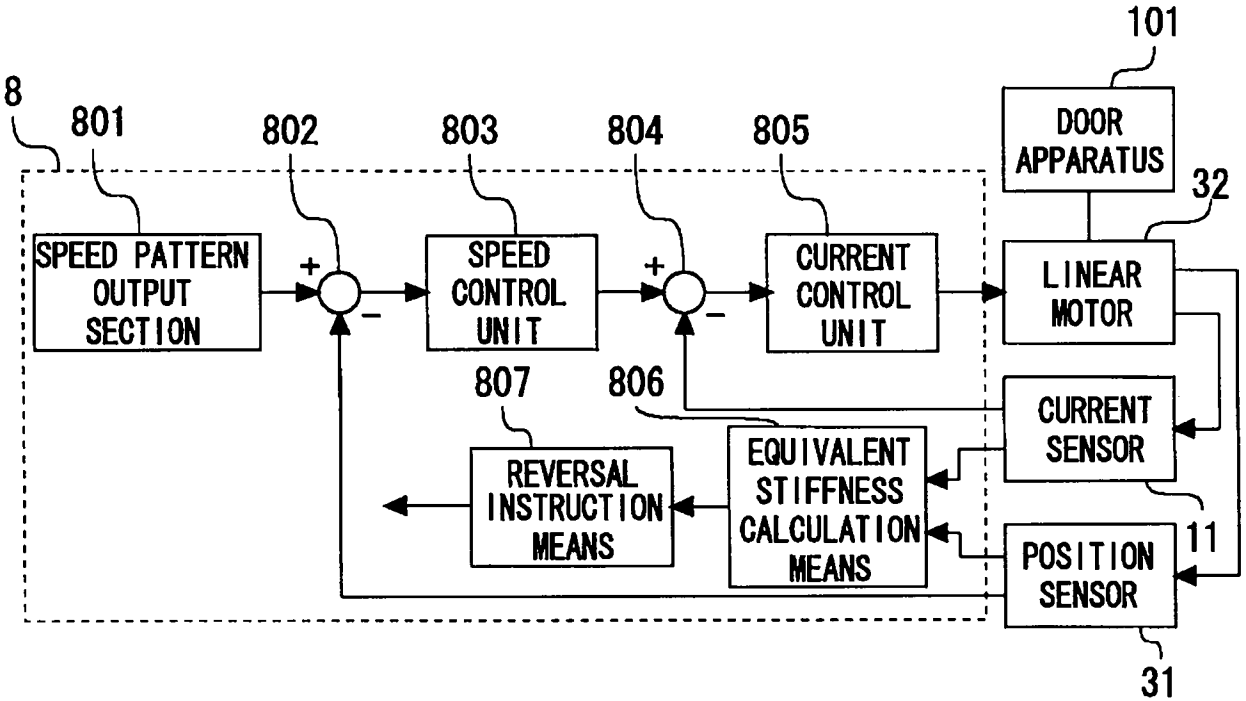
FIG. 11 is a control block diagram in Embodiment 5 of the present invention.

FIG. 11 is a control block diagram of Embodiment 5. In FIG. 11, the descriptions of reference numerals 8, 11 and 801 to 807 are the same as in FIG. 2, corresponding parts bearing like numerals, and hence these descriptions are omitted here. The difference in configuration between FIG. 2 and FIG. 11 in that in FIG. 11, a linear motor 32 is provided in place of the electric motor 9 and a position sensor 31 is provided in place of the rotation sensor 16.

In Embodiments 1 to 4 above, the equivalent stiffness of an object in contact is derived from the ratio of a quantity corresponding to the driving torque of the electric motor 9 to a quantity corresponding to the rotation quantity. However, in the configuration using the linear motor 32 shown in Embodiment 5, it is apparent that the equivalent stiffness of an object in contact can be similarly derived from the ratio of a quantity corresponding to the driving force of the linear motor 32 to a quantity corresponding to the moving quantity.

Therefore, also in the case where the linear motor 32 is used as in Embodiment 5, contact is determined by paying attention not only to the current value corresponding to the driving force of the linear motor 32, but also to the moving quantity of the linear motor and, therefore, it is possible to reduce the effect of a disturbance occurring with time such as friction. Therefore, because the determination threshold value of equivalent stiffness can be set to be a small value without being affected by a disturbance such as friction, it becomes possible to detect the collision of the door panel 1 earlier, with the result that the invention has the remarkable effect that a contact force on the human body and the like can be reduced.

Embodiment 6

Embodiment 6 of the present invention will be described with the aid of FIGS. 12 to 14.

Figure 12:
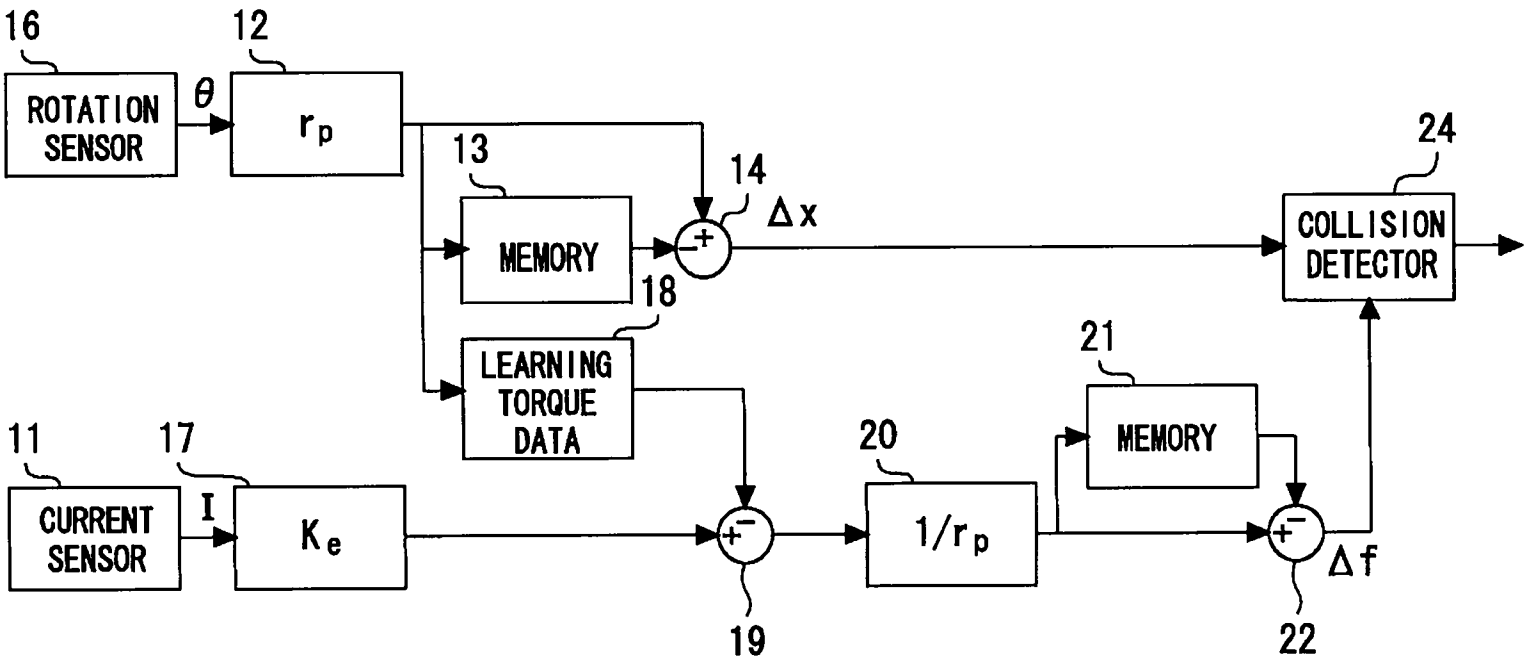
FIG. 12 is a block diagram showing the equivalent stiffness calculation means in Embodiment 6 of the present invention.

FIG. 12 is a block diagram showing the details of the equivalent stiffness calculation means 806 in which a method different from that of Embodiment 1 is used. Embodiment 6 uses the same method as Embodiment 1 shown in FIG. 3 until the moving quantity difference $\Delta x$ is calculated by use of the subtractor 14 and the increased force $\Delta f$ is calculated by use of the subtractor 22.

Figure 13:
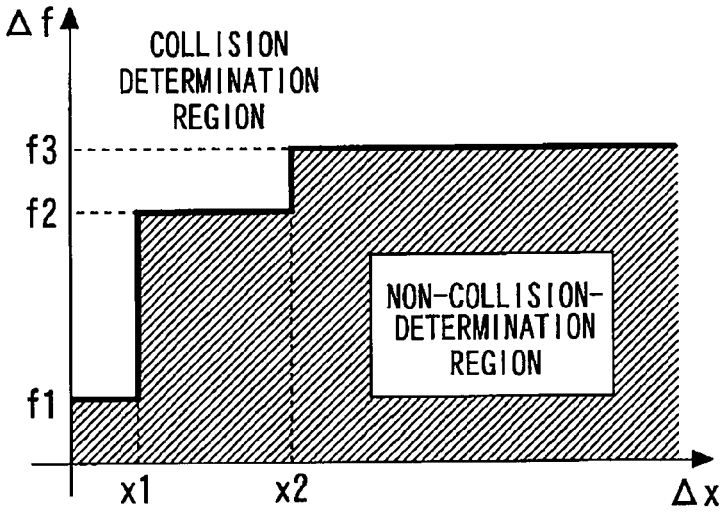
FIG. 13 is a graph explaining a collision determination region in Embodiment 6 of the present invention.

However, in Embodiment 6, the $\Delta x$-$\Delta f$ plane is divided into a collision determination region and a non-collision-determination region as shown in FIG. 13 and a collision is detected from $\Delta x$ and $\Delta f$ which are inputted to the collision detector 24. In the $\Delta x$-$\Delta f$ plane shown in FIG. 13, the top-left region becomes a region in which equivalent stiffness is large (the collision determination region) and the bottom-right region (a hatched portion) becomes a region in which equivalent stiffness is small (the non-collision-determination region). Therefore, in the case where the ($\Delta x$, $\Delta f$) points inputted to the collision detector 24 are present in the collision determination region, the collision detector 24 outputs a collision signal and the door panel 1 is controlled so as to be reversed.

Figure 14:
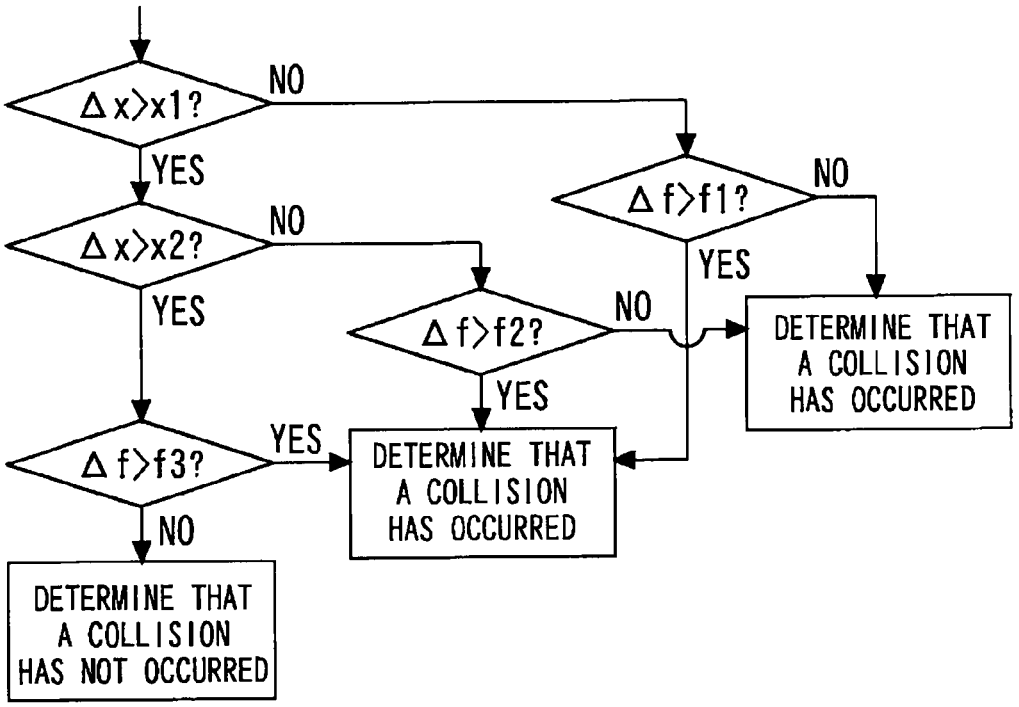
FIG. 14 is a flowchart showing a collision determination flow in Embodiment 6 of the present invention.

A more concrete collision determination flow based on FIG. 13 is shown in FIG. 14. Region dividing is performed according to the size of inputted $\Delta x$. In the case where $\Delta x$ is smaller than x1, it is determined that a collision has occurred if $\Delta f$ is larger than f1. When $\Delta x$ is intermediate between x1 and x2, it is determined that a collision has occurred if $\Delta f$ is larger than f2. When $\Delta x$ is larger than x2, it is determined that a collision has occurred if $\Delta f$ is larger than f3.

In this embodiment, the $\Delta x$-$\Delta f$ plane is divided into regions specified by the five dividing parameters x1, x2, f1, f2, f3. However, the $\Delta x$-$\Delta f$ plane may be divided finely using a larger number of parameters and the $\Delta x$-$\Delta f$ plane may be divided roughly using a smaller number of parameters.

Using a plurality of dividing parameters like this requires the memory capacity for storing the dividing parameters. However, the present invention has the effect that it becomes also possible to consider the complex nonlinear characteristics of equivalent stiffness for determining a collision.

Although specific examples for calculating the equivalent stiffness of an object in contact were described in Embodiments 1, 2 and 6, it is not necessary that a method of calculating equivalent stiffness be strictly the same as these examples. It is necessary only that a method be able to calculate a value which can be associated with as the ratio of the driving torque or driving of the electric motor 9 or linear motor 32, which is an example of a driving device, to the rotation quantity or the moving quantity.

The invention claimed is:

1. A control device of an elevator door, comprising:

a door panel which opens and closes a hall;

a driving device which drives the door panel in opening and closing;

a moving quantity detector which detects the rotation quantity or moving quantity of the driving device;

a driving force detector which detects a driving torque or driving force of the driving device or calculates a driving torque instruction value or a driving force instruction value to the driving device; and equivalent stiffness calculation means which estimates equivalent stiffness of an object in contact with the door panel from an output signal of the moving quantity detector and an output signal of the driving force detector, wherein the equivalent stiffness is based on a ratio of a change in the detected or calculated driving force or driving torque, or driving torque instruction value, or driving force instruction value, to a change in the detected rotation quantity or moving quantity of the driving device, wherein the door panel is caused to be reversed or to stop by comparing the estimated equivalent stiffness of an object in contact as a contact determination parameter with a threshold value.

2. The control device of an elevator door according to claim 1, further comprising:

force reference value estimation means which estimates a torque reference value or force reference value of the driving device during normal opening and closing;

wherein the equivalent stiffness calculation means estimates equivalent stiffness of an object in contact from an output signal of the moving quantity detector, an output signal of the driving force detector and an output of the force reference value estimation means.

3. The control device of an elevator door according to claim 2, wherein the force reference value estimation means estimates a reference value from learning torque data or learning force data during the past opening and closing of the door panel.

4. The control device of an elevator door according to claim 2, wherein the force reference value estimation means estimates a torque reference value or a force reference value from a door panel opening and closing speed instruction pattern, a door panel weight parameter and a disturbance parameter in normal times.

5. The control device of an elevator door according to claim 1, wherein the control device is used only when the door panel is controlled in the direction in which the door panel is closed.

6. The control device of an elevator door according to claim 1, wherein the driving device is an electric motor, the moving quantity detector is a rotation sensor attached to the electric motor, and the driving force detector is a current sensor which detects currents flowing through the electric motor.

7. The control device of an elevator door according to claim 2, wherein the driving device is an electric motor, the moving quantity detector is a rotation sensor attached to the electric motor, and the driving force detector is a current sensor which detects currents flowing through the electric motor.

8. The control device of an elevator door according to claim 3, wherein the driving device is an electric motor, the moving quantity detector detection means is a rotation sensor attached to the electric motor, and the driving force detector detection means is a current sensor which detects currents flowing through the electric motor.

9. The control device of an elevator door according to claim 4, wherein the driving device is an electric motor, the moving quantity detector is a rotation sensor attached to the electric motor, and the driving force detector is a current sensor which detects currents flowing through the electric motor.

10. The control device of an elevator door according to claim 5, wherein the driving device is an electric motor, the moving quantity detector is a rotation sensor attached to the electric motor, and the driving force detector is a current sensor which detects currents flowing through the electric motor.

* * * * *